US005432538A

United States Patent [19]

Carlotta

[11] Patent Number: 5,432,538

[45] Date of Patent: Jul. 11, 1995

[54] VALVE FOR AN INK JET PRINTER MAINTENANCE SYSTEM

[75] Inventor: Michael Carlotta, Sodus, N.Y.

[73] Assignee: Xerox Corporation, Stamford, Conn.

[21] Appl. No.: 976,134

[22] Filed: Nov. 12, 1992

[51] Int. Cl.[6] ..... B41J 2/165

[52] U.S. Cl. ..... 347/30; 251/10

[58] Field of Search ..... 346/140 R; B41J 2/165; 251/4, 6, 7, 10; 347/29, 30, 32

[56] References Cited

U.S. PATENT DOCUMENTS

| | | | |
|---|---|---|---|
| Re. 32,572 | 1/1988 | Hawkins et al. | 156/626 |
| 4,364,065 | 12/1982 | Yamamori et al. | 346/140 R |
| 4,571,599 | 2/1986 | Rezanka | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140R |

FOREIGN PATENT DOCUMENTS

| | | | |
|---|---|---|---|
| 424859 | 5/1991 | European Pat. Off. | B41J 2/165 |
| 691496 | 5/1953 | United Kingdom | 251/10 |

*Primary Examiner*—Benjamin R. Fuller
*Assistant Examiner*—Alrick Bobb

[57] ABSTRACT

A valve is disclosed for use in a maintenance station for an ink jet printer. The maintenance station has a carriage on which a cap that selectively seals the printhead nozzle is mounted. The carriage is movable in and relative to a fixed support member of the maintenance station. A flexible hose interconnects the cap with a pneumatic source for the removal of air and ink from the cap. The selective movement of the carriage towards and away from a wall of the support member pinches the flexible hose closed between them without requiring closely toleranced movement of the carriage.

5 Claims, 3 Drawing Sheets

VALVE FOR AN INK JET PRINTER MAINTENANCE SYSTEM

BACKGROUND OF THE INVENTION

The present invention relates to ink jet printing apparatus and is concerned, more particularly, with a valve for the printing apparatus maintenance system for a printhead in such apparatus.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before initial use, to ensure that the printhead channels are completely filled with ink and contain no contaminants or air bubbles. After much printing and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938 while the removal of gas from the ink reservoir of a printhead during printing is described in U.S. Pat. No. 4,679,059.

The priming operation involves either forcing or drawing ink through the printhead and out the printhead nozzles, while the nozzles are sealingly enclosed by a cap. This means that hoses or conduits must be provided to remove the ink removed from the printhead during the priming operation. Depending upon which priming stage the maintenance station is in, a valve must be used to close periodically the hoses and isolate the cap. Since the hoses are normally open, the valve must be opened and closed, and, therefore, a robust cost effective valve is required to effect this closure. The most widely used priming technique for thermal ink jet printers is to subject the printhead nozzles to a vacuum or negative pressure to withdraw ink from the nozzles rather than to subject the printhead to pressure to force the ink from the nozzles. Accordingly, the maintenance station for a thermal ink jet printhead generally uses a vacuum pump to suck or draw ink from the printhead nozzles. However, many valves used to close off the maintenance station caps tend to fail with use because of the accumulation of ink in crevices, corners, and the like, which dry out. This dried ink within the valves causes them to fail eventually. Ball and seat valves and flapper valves are especially vulnerable to this failure mode.

SUMMARY OF THE INVENTION

It is an object of the present invention to provide a robust valve with a smooth internal surface without areas for ink to collect and dry.

In the present invention, a maintenance station for an ink jet printer having a printhead with nozzles in a nozzle face and an ink supply cartridge (print cartridge) is mounted on a translatable carriage for concurrent movement therewith. When the printer is in a non-printing mode, the carriage is translated to the maintenance station located outside and to one side of a printing zone, where various maintenance functions are provided depending upon the location of the carriage mounted printhead within the maintenance station. At one location in the maintenance station, a carriage actuatable cap is caused to move into sealing engagement with the printhead nozzle face and surround the printhead nozzles to provide a controllable environment therefor. A vacuum pump is interconnected to the cap by flexible hose with an ink/air separator therebetween. Priming is conducted when continued movement of the carriage mounted printhead to a predetermined location actuates a pinch valve of the present invention to isolate the separator from the cap for a predetermined time and enable a predetermined vacuum to be produced therein by energizing the vacuum pump. One example of a pinch valve according to the present invention is a U-shaped pinch valve which comprises two connected legs. One leg of the U-shaped valve is stiff and does not bend or deflect, and the other leg is relatively flexible. The flexible leg is designed to deflect a predetermined amount depending upon positional tolerances of the print cartridge carriage. The pinch valve material may be any material providing flexibility of the legs relative to each other, but is preferably a plastic material that is not attacked by stray ink. The stiff leg of the U-shaped pinch valve is pivoted about a cylindrical shaft integral therewith and rotatably mounted in the maintenance station adjacent the flexible hose. Movement of the carriage to another location places the flexible leg of the U-shaped pinch valve into contact with a fixed structure, thereby causing the pinch valve to rotate about its shaft on the stiff leg and to press the stiff leg against the flexible hose, pinching it closed against a wall of the maintenance station. The pinch valve provides no crevices or irregularities which could collect ink, whether the valve is open or closed. The movement of the carriage does not need to be tightly toleranced, because the legs of the U-shaped pinch valve flex relative to each other and prevent the application of excessive force on the hose which might damage it. When the printer is in a non-printing mode, the carriage mounted printhead is at the capping location and the pinch valve is open. If the manual priming button is pushed, the print cartridge carriage moves a maintenance or cap carriage containing the actuatable cap, and the two carriages move in unison to a valve closed or pinched position. The vacuum pump is energized and the maintenance system is evacuated from the closed pinch valve through the hoses and separator to the vacuum pump. Once the carriage mounted printhead returns to the capping location, the pinch valve is opened subjecting the printhead to the separator vacuum and ink is drawn from the printhead nozzles to the separator. Before pressures internal to the cap and cartridge are equalized, movement of the carriage mounted printhead to another location uncaps the nozzle face to stop the prime and enables ink to be dynamically removed from the cap and hoses to the separator. The vacuum pump is de-energized and the printhead is returned to the capping location to await the printing mode of the printer. The predetermined time that the cartridge is at the pinch location and the predetermined time that the cartridge is at the capping location (as controlled by the controller software) determines pressure profiles and waste volumes. This control enables a spectrum of waste volumes and pressure profiles, two of which include: (a) cartridge initial install (longer wait at the capping location to prime all ink flow paths between the nozzles and the supply cartridge), and (b) refresh prime (shorter wait at the capping location to prime the printhead).

BRIEF DESCRIPTION OF THE DRAWINGS

By way of example, an embodiment of the invention will be described with reference to the accompanying drawings, wherein like numerals indicate like parts and in which.

DESCRIPTION OF THE PREFERRED EMBODIMENT

Figure 1:
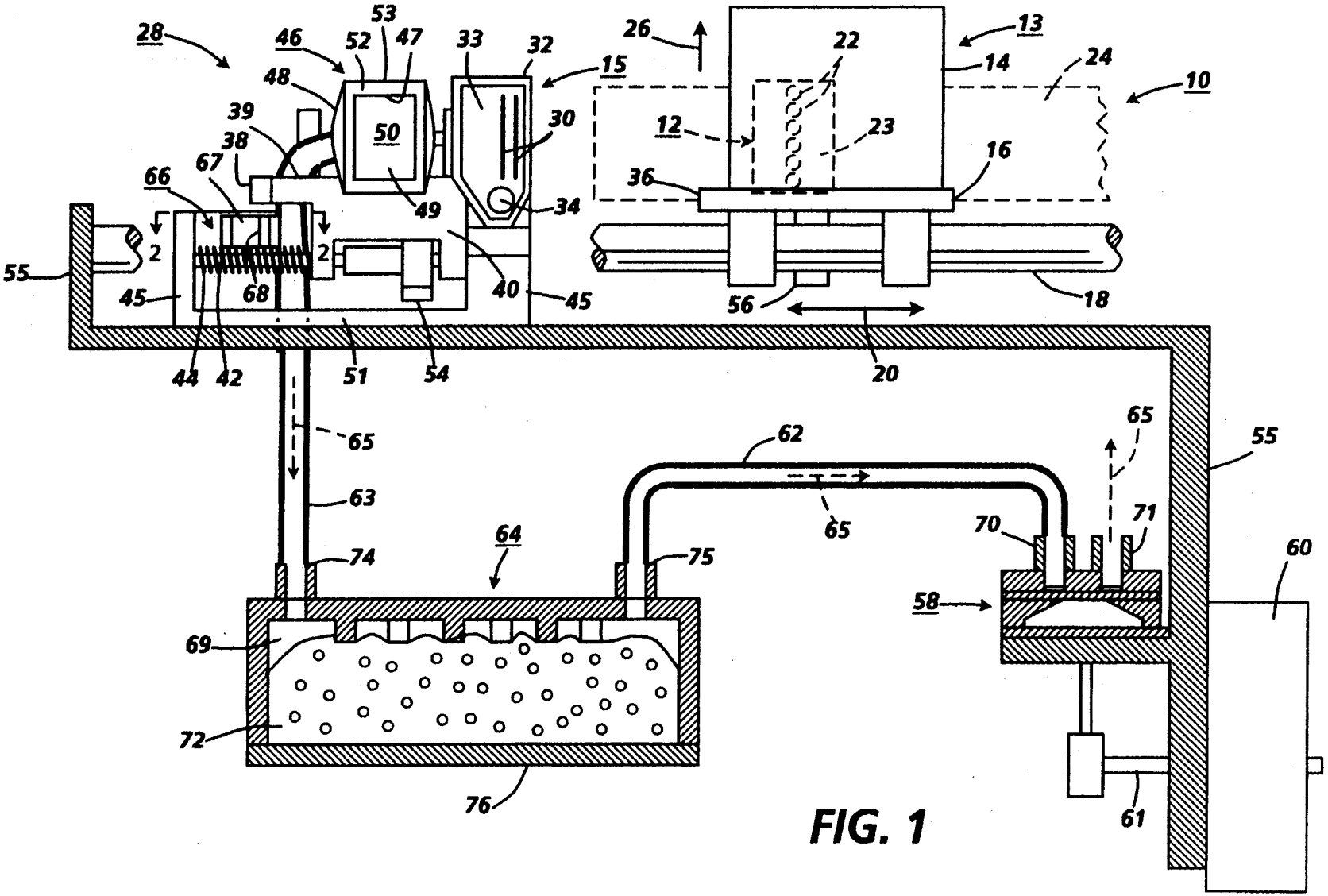
FIG. 1 is a schematic front elevation view of a partially shown ink jet printer having the maintenance station with the pinch valve of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past at least one fixed wiper blade 30 and preferably a pair of fixed, but separate, parallel, spaced wiper blades, so that the printhead nozzle face 23 is wiped free of ink and debris every time the printhead and cartridge (hereinafter print cartridge) enters or exits the maintenance station. Adjacent the wiper blade in the direction away from the printing zone and at a predetermined location along the translating path of the print cartridge is a fixedly mounted collection container 32. The carriage will position the print cartridge at this collection container, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the printer blades, cleaning the nozzle face, and to the predetermined location confronting the collection container, whereat the printer controller causes the printhead to eject a number of ink droplets therein. In the preferred embodiment, the printhead will eject about 100 ink droplets into the collection container. Preferably, the wiper blade or blades are also located within the collection container so that ink may run or drip off the blades and be collected in the collection container. The collection container has a surface 33 which is substantially parallel to the printhead nozzle face and oriented in a direction so that the force of gravity causes the ink to collect in the bottom thereof where an opening 34 is located for the ink to drain therethrough into a pad of absorbent material (not shown) behind the collection container. The pad of absorbent material absorbs the ink and is partially exposed to the atmosphere, so that the liquid portion of the ink absorbed therein evaporates maintaining adequate ink storage volume for repeated subsequent cycles of priming and nozzle clearing droplet ejections.

When the carriage 16 continues along guide rails 18 beyond the collection container for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the collection container by spring 44 which surrounds guide rail 42. The cap 46 has a closed wall 47 extending from a bottom portion 48 of the cap to provide an internal recess 49 having a piece of absorbent material 50 therein. The top edge 52 of the wall 47 and preferably the outside surfaces of wall 47 including the top edge is covered by a resilient rubber like material 53, such as, Krayton ®, a product of Shell Chemical Company, a 45 durometer shore A material which is compliant enough to form a good seal. In the preferred embodiment, resilient material 53 is molded onto the outside walls of wall 47. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents excessive relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62, 63 and an ink separator 64 is located intermediate the cap and vacuum pump.

Figure 2:
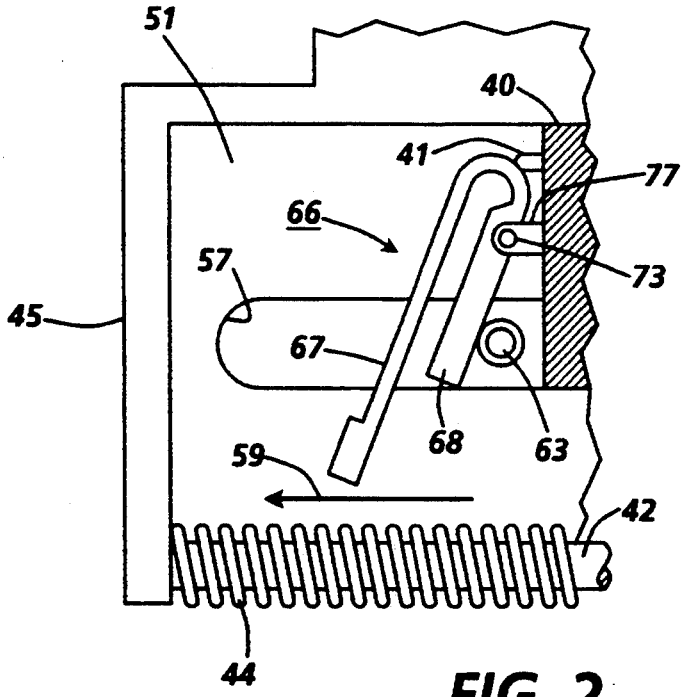
FIG. 2 is a partial cross-sectional view of the maintenance station as viewed along section line 2—2 in FIG. 1 showing the carriage actuated pinch valve of the present invention.

The cap carriage guide rail 42 is fixedly positioned between fixed upstanding support members 43, 45 which extend from base 51 removably attached to the printer frame 55. Referring also to FIG. 2, base 51 has an elongated slot 57 for passage of the flexible hose 63 and to accommodate movement of the flexible hose therein. A pinch valve 66 having a U-shaped structure is rotatably attached to the cap carriage 40 by a fixed cylindrical shaft 73 on leg 68 of the U-shaped structure, which is pivoted in flanges 77, so that movement of the cap carriage toward upstanding support member 45, as indicated by arrow 59, will eventually bring the other leg 67 of the U-shaped structure into contact with fixed support member 45, pinching the flexible tube 63 closed. The U-shaped pinch valve comprises two connected legs 67, 68, one leg 68 being shorter and stiffer than the other leg 67. The pinch valve material may be any material providing flexibility of leg 67 relative to leg 68, but is preferably a plastic material that is not attacked by stray ink. The shorter leg of the U-shaped pinch valve is pivoted about the cylindrical shaft 73 integral therewith and extending in opposite directions therefrom. When rotatably mounted in the flanges 77, which are fixed to the cap carriage 40, the axis of rotation of the pinch valve about the shaft 73 is perpendicular to the direction of translation of the print cartridge carriage 16 and cap carriage 40, which move in unison together once the carriage actuator edge 36 meets cap carriage catch 38. The pinch valve leg 68 is adjacent the flexible hose and sandwiches the flexible hose 63 between the short leg 68 and the cap carriage 40, but provides little or no contact with the flexible hose, when leg 67 does not contact the support member 45. A projection 41 extends from the cap carriage into contact with the connecting U-shaped portion of the pinch valve to act as a stop and limit rotation of the pinch valve in a direction away from the flexible hose. Movement of the cap carriage 40 to another predetermined location in the direction of arrow 59 places the longer leg 67 of the U-shaped pinch valve into contact with fixed support member 45, thereby causing the pinch valve to rotate about its shaft on the short leg and to press the shorter leg against the flexible hose, pinching it closed against a wall of the cap carriage 40. The pinching closed of the hose by the pinch valve provides a smooth valve surface, viz., the internal surface of the flexible hose 63 which has no crevices or irregularities which could collect ink whether pinched closed or not. The movement of the carriage does not need to be tightly toleranced, because the leg 67 of the U-shaped pinch valve flexes relative to the shorter leg 67 and acts somewhat like a spring lever to prevent the application of excessive force on the hose which might damage it.

Figure 3:
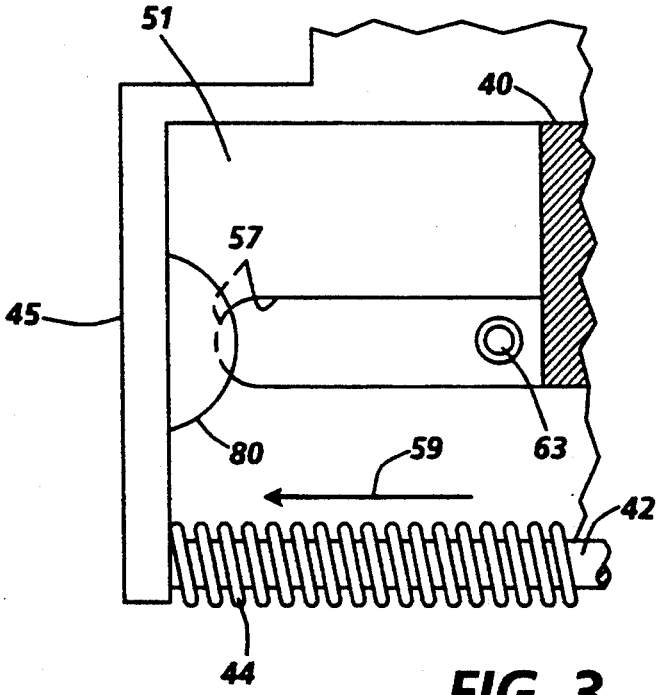
FIG. 3 is a view similar to FIG. 2 showing an alternate embodiment of the present invention.

An alternate embodiment is shown in FIG. 3, a view similar to that shown in FIG. 2. The basic requirement of the present invention is to pinch or squeeze the flexible hose 63 closed by movement of the cap carriage 40 in unison with and under the force of the print cartridge carriage 16 in a direction from the capping location away from the collection container 32, so that the flexible hose 63 is pinched by a compliant or resilient member to prevent the application of excessive force on the hose without requiring costly closely toleranced movement of the print cartridge carriage 16. This is accomplished in the embodiment of FIG. 3 by a resilient stop 80 on fixedly mounted on fixed support member 45 and located in a position to intercept the flexible hose as it is guided along slot 57. Any material not attacked by stray ink will suffice for the stop 80, which may include any shape including a hemispherical shape as shown. The movement of cap carriage pushes the flexible hose 63 along the slot 57 until stop 80 pinches the flexible hose closed against a wall of the cap carriage.

Figure 4:
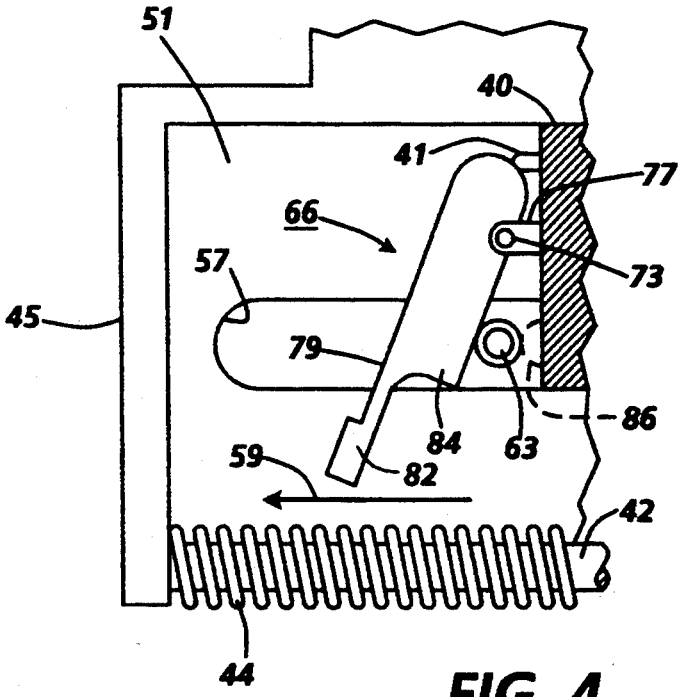
FIG. 4 is a view similar to FIG. 2 showing another alternate embodiment of the present invention.

Another embodiment of the pinch valve 66 is shown in FIG. 4, where a single lever 79 having a stiff, rigid section 84 and a thinner flexible section 82 operates to pinch the flexible hose 63 in a manner similar to the embodiment of FIG. 2. Optionally, a resilient stop 86, shown in dashed line, may be mounted on the adjacent wall of the cap carriage 40 in a position to intercept the flexible hose as the lever 79 is pivoted about the shaft 73 in flanges 77 to pinch the flexible hose closed. The flexible section 82 of the lever 79, should, however, provide sufficient protection to prevent excessive force on the flexible hose 63 when it is pinched closed by the single lever 79 of pinch valve 66.

Figure 5:
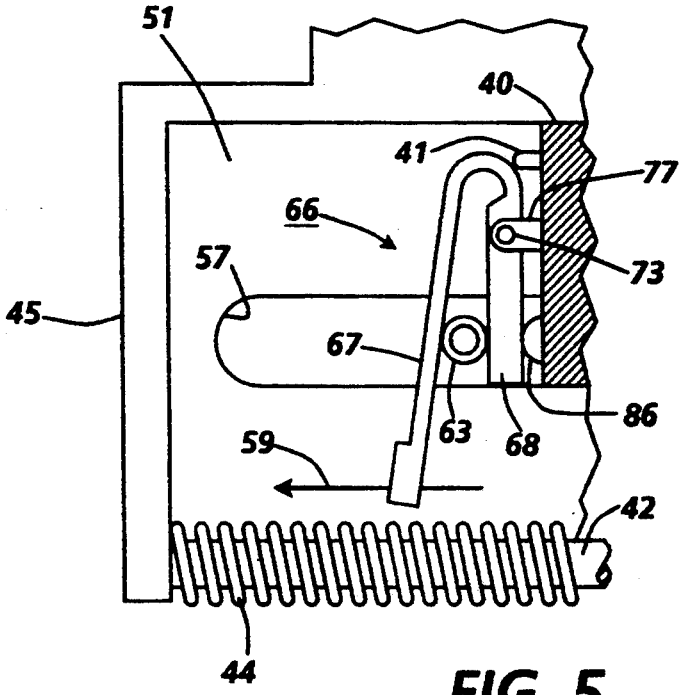
FIG. 5 is a view similar to FIG. 2 showing yet another alternate embodiment of the present invention.

In another embodiment of the pinch valve 66 shown in FIG. 5, the flexible hose is pinched between the flexible leg 67 against the stiff leg 68 of the U-shaped pinch valve configuration of FIG. 2. One additional feature different from the embodiment in FIG. 2, besides the relocation of the flexible hose to a position between the legs of the U-shaped pinch valve, is the addition of the stop 86 between the stiff leg 68 and the cap carriage 40 to hold the stiff leg 68 against the flexible hose, but without causing the generation of a force thereon, and to add more resilience in the squeezing force to the flexible leg 67 against the stiff leg 68.

Thus, at one predetermined location along guide rails 18 the print cartridge, through engagement of the carriage actuator edge 36 and catch 38 of the cap carriage, will cause the printhead nozzle face to be capped, but the tube 63 will not be pinched shut. This will be referred to as the capped position, and the nozzle face is subjected to humidified, ambient pressure air through the cartridge vent (not shown) and vacuum pump valves 70, 71 through separator 64.

When it is necessary to prime the printhead, the carriage 16 is moved from the capped position towards fixed support member 45 until the flexible hose 63 is pinched closed. In the embodiment of FIG. 2, the carriage 16 is moved until the leg 67 of U-shaped pinch valve 66 contacts support member 45 causing the U-shaped pinch valve to rotate, so that leg 68 of the U-shaped structure pivots against flexible hose 63 and pinches it closed, i.e., pinch valve 66 is caused to close flexible hose 63 by movement of the carriage 16. Paper feed motor 60 is energized and diaphragm vacuum pump 58 evacuates separator chamber 69, partially filled with an absorbent material, such as reticulated polyurethane foam 72, to a negative pressure of about minus 120 inches of $H_2O$. This negative pressure is attained in about 10 to 12 seconds, depending on pump design. Meanwhile the cap recess is still at ambient pressure because of the pinch valve closure. When the desired separator negative pressure is achieved, after about 10 seconds, the carriage is returned to the location where the nozzle face is capped, but the flexible hose 63 is no longer pinched closed. At this point, the cap is still sealed to the printhead nozzle face and the pinch valve is opened thereby subjecting the sealed cap internal recess to a negative pressure of minus 120 inches of $H_2O$. The print cartridge remains at this position for about one second. This time period is determined to achieve a specific relationship of pressure in the cap and flow impedance of the ink through the nozzles and the maintenance system air volume in order to yield a priming target of 0.2 cc$\pm$0.05 cc of ink. The pinch valve pinches the flexible hose 63 closed at time zero seconds, and with the vacuum pump running, causes the pressure to begin dropping in the separator 64. The cap 46 is sealed to the printhead nozzle face 23 and no pressure is reduced in the cap because the flexible hose is pinched closed. After about 12 seconds, the cap carriage 40 is allowed to move in a direction away from support member 45 under the urging of spring 44 and pawl 54, when the print cartridge carriage 16 is moved in a direction toward the wiper blade(s) 30, back to the capping position. At this point the pinch valve is open, about 12 to 18 seconds from flexible hose pinch off, the negative pressure from the separator is introduced to the cap and ink is sucked from the nozzles. The negative pressure begins to drop due to the flow of ink. After about one second, the carriage 16 then moves breaking the cap seal and stopping the priming. The cap pressure drops and returns to ambient. The print cartridge is moved past the wiper(s) 30 to a hold position adjacent the wiper(s) at a location between the wiper(s) and the printing zone for a predetermined time period to wait while the ink and air are sucked or purged from the cap to the separator. When this has been accomplished, the carriage returns the print cartridge to the capped position to await for a printing mode command from the printer controller.

The predetermined time that the print cartridge is at a location where the flexible hose 63 is pinched closed and the predetermined time that the print cartridge is at the capped position (as controlled by the controller software) determines pressure profiles and waste volumes of ink. This control enables a spectrum of waste ink volumes and pressure profiles, two of which are when the print cartridge is initially installed (longer wait at the capped position to prime all ink flow paths between the nozzle and the supply cartridge) and refresh or manual prime, discussed below (shorter wait at the capped position to prime the printhead).

Optionally, a manual prime button (not shown) is provided on the printer for actuation by a printer operator when the printer operator notices poor print quality caused by, for example, a nozzle that is not ejecting ink droplets. This manual priming by actuation of the manual prime button works substantially the same way as the automatic prime sequence described above, which is generally performed when the print cartridge is installed or any other sensed event which is programmed into the printer controller. The only difference is that the amount of lapsed time is reduced to 0.5 seconds after the pinch valve is opened to reduce the amount of ink sucked from the print cartridge to about 0.1 cc to reduce waste ink and prevent reduced printing capacity per print cartridge. Occasionally, a manual refresh prime may not be sufficient to improve print quality. Therefore, the controller with appropriate software would invoke the initial prime volumes after continued attempts were made to recover via manual refresh prime. For example, after two consecutive manual refresh prime attempts within a two minute period, the third attempt would be made by the printer controller at initial prime ink volumes.

While the cap is being purged of ink and the print cartridge is in the hold position, the paper feed motor is operating the vacuum pump to pump air and ink from the cap into the separator. Once in the separator, the ink is absorbed by the foam which stores the ink and prevents ink from entering the pump. (Ink in the pump could damage pump valves.) Above the foam in the separator is a chamber having a serpentine air passageway which connects the inlet 74 and outlet 75 of the separator. This passageway makes it impossible for airborne ink to reach the outlet which could lead to pump ingestion of ink. The floor 76 of the separator is made of a material that is strategically selected for its Moisture Vapor Transfer Rate (MVTR). During months of use, fluid will be lost through this migration phenomena. Any time the paper feed motor is turning for any reason other than maintenance, the print cartridge must be away from the cap, otherwise unwanted ink would be drawn into the cap. When the paper feed motor is turning for reasons other than maintenance, and the printer cartridge is away from the cap, the pump operates and continues to pump air through the maintenance station system purging ink from the cap to the separator. This provides extra insurance which prevents ink from collecting in flexible hose 63, drying and blocking flow therethrough.

Many modifications and variations are apparent from the foregoing description of the invention, and all such modifications and variations are intended to be within the scope of the present invention.

I claim:

1. A valve for use in a maintenance station for an ink jet printer with a printhead having droplet-ejecting nozzles, the maintenance station having a translatable cap carriage with a cap movably mounted thereon, a support member fixed to the printer on which the cap carriage is mounted for translation thereon, a pneumatic source, and a flexible, collapsible hose with a smooth interior surface connecting the cap to the pneumatic source for the passage of air and/or ink through the hose, the support member having a wall extending therefrom and spaced from the cap carriage so that translation of the cap carriage moves the cap carriage towards and away from the support member wall; and a portion of said hose being located adjacent the cap carriage, the valve comprising:

a lever pivotally mounted on the cap carriage and having a stiff section and a flexible section, the stiff section being pivotally mounted for rotation in fixed flanges on the cap carriage and including means for moving the cap carriage towards the support member wall to a location whereat the flexible section of the lever contacts the support member wall causing the lever to pivot towards the cap carriage and apply a force by the lever stiff section against the hose which is sandwiched between the lever stiff section and the cap carriage and pinches the hose closed, thereby preventing flow therethrough, the hose returning to an original shape when the force is removed by the movement of the cap carriage away from the support member wall, thereby permitting flow therethrough, the portion of the hose sandwiched between the lever and cap carriage forming a part of the valve, so that the smooth interior of the hose prevents the formation of internal crevices or irregular surface areas which trap or collect ink when the hose is pinched closed by the force applied by the lever or the hose is opened when the force by the lever is removed, and whereby both the flexible section of the lever and the flexibility of the hose provide for a compliance necessary to prevent excessive force of the hose without requiring closely toleranced movement of the cap carriage.

2. The valve of claim 1, wherein a resilient stop is positioned on the cap carriage between and adjacent to the hose to space the hose from the cap carriage and provide additional compliance for the hose when the hose is pinched by the lever.

3. The valve of claim 1, wherein the lever is a U-shaped member of unitary construction having a flexible longer leg and a shorter stiff leg connected to each other by an arcuate section, each leg having a distal end opposite an end connected to the arcuate section, whereby the lever's flexible section is the longer leg and the stiff section is the shorter leg;

wherein the pivotal mounting of the lever comprises a shaft having an axis of rotation fixed to the shorter leg adjacent the arcuate section, the shaft being rotatably mounted in said fixed flanges on the cap carriage for rotation of the U-shaped member, so that the flexible hose is parallel to the axis of rotation of the shaft and sandwiched between the cap carriage and the shorter leg of the U-shaped member; and wherein said movement of the cap carriage towards the support member wall places the distal end of the flexible longer leg into contact with said wall and rotates the U-shaped member in the flanges to cause the shorter leg to pinch the hose closed, the flexible longer leg providing additional compliance to further protect the hose from excessive force and relaxing the tolerance of the movement of the cap carriage.

4. The valve of claim 1, wherein the flexible hose is parallel to the axis of rotation of the shaft and is sandwiched between the longer leg and the shorter leg of the U-shaped member.

5. The valve of claim 4, wherein the valve further comprises a resilient stop fixedly attached to the cap carriage between and adjacent to the shorter leg of the U-shaped member, so that contact of the longer leg with the support member wall causes the longer leg to pinch the hose closed against the shorter leg, but the shorter leg is cushioned by the stop.

* * * * *